US010598449B2

(12) United States Patent
Tischler et al.

(10) Patent No.: US 10,598,449 B2
(45) Date of Patent: Mar. 24, 2020

(54) SELF-ROTATING TUBE CLEANING NOZZLE ASSEMBLY

(71) Applicant: Federal Signal Corporation, Oak Brook, IL (US)

(72) Inventors: Dieter A. Tischler, Houston, TX (US); Ron Darcy, Oak Brook, IL (US)

(73) Assignee: Federal Signal Corpoation, Oak Brook, IL (US)

( * ) Notice: Subject to any disclaimer, the term of this patent is extended or adjusted under 35 U.S.C. 154(b) by 180 days.

(21) Appl. No.: 15/783,479

(22) Filed: Oct. 13, 2017

(65) Prior Publication Data

US 2018/0106565 A1 Apr. 19, 2018

Related U.S. Application Data

(60) Provisional application No. 62/409,288, filed on Oct. 17, 2017.

(51) Int. Cl.

| | |
|---|---|
| ***F28G 3/16*** | (2006.01) |
| ***B08B 9/032*** | (2006.01) |
| ***B08B 9/043*** | (2006.01) |
| ***B05B 3/06*** | (2006.01) |
| ***B05B 13/06*** | (2006.01) |

(52) U.S. Cl.

CPC ..... *F28G 3/163* (2013.01); *B05B 3/06* (2013.01); *B05B 13/0636* (2013.01); *B08B 9/032* (2013.01); *B08B 9/0433* (2013.01); *B08B 2209/032* (2013.01); *B08B 2209/04* (2013.01)

(58) Field of Classification Search

None

See application file for complete search history.

(56) References Cited

U.S. PATENT DOCUMENTS

| | | | |
|---|---|---|---|
| 4,164,325 | A | 8/1979 | Watson |
| 4,923,120 | A | 5/1990 | Hammelmann |
| 4,967,841 | A | 11/1990 | Murray |
| 5,104,043 | A | 4/1992 | Pacht |
| 5,135,170 | A | 8/1992 | Takeda et al. |
| 5,351,891 | A | 10/1994 | Hansen et al. |
| 5,685,487 | A | 11/1997 | Ellis |
| 5,909,848 | A | 6/1999 | Zink |
| 5,964,414 | A | 10/1999 | Hardy et al. |
| 6,027,040 | A | 2/2000 | Frye-Hammelmann |
| 6,059,202 | A | 5/2000 | Zink et al. |

(Continued)

FOREIGN PATENT DOCUMENTS

EP 1163959 A2 12/2001

*Primary Examiner* — Rita P Adhlakha

(74) *Attorney, Agent, or Firm* — Merchant & Gould P.C.

(57) ABSTRACT

A self-rotating tube cleaning nozzle assembly is disclosed that includes at least one debris exclusion feature. The nozzle assembly includes a main body defining an internal fluid passageway, a nozzle mounted to the main body, and a sleeve rotatably disposed about the main body. In one aspect, the sleeve having at least one discharge port in fluid communication with the main body internal fluid passageway for discharging a spray and rotating the sleeve about the main body. The debris exclusion feature is defined between the main body and the sleeve and includes a stepped portion on an exterior surface of the main body that faces and overlaps with a complementarily shaped stepped portion on an interior surface of the sleeve. The debris exclusion feature forms a tortuous pathway that eliminates or reduces contaminant ingress.

17 Claims, 6 Drawing Sheets

(56) References Cited

U.S. PATENT DOCUMENTS

| | | | |
|---|---|---|---|
| 6,189,618 | B1 | 2/2001 | Beeman et al. |
| 6,698,669 | B2 | 3/2004 | Rieben |
| 7,198,456 | B2 | 4/2007 | Koll et al. |
| 7,546,959 | B2 | 6/2009 | Wagner et al. |
| D617,870 | S | 6/2010 | Wright |
| 8,006,920 | B2 | 8/2011 | Wright et al. |
| 8,298,349 | B2 | 10/2012 | Wojciechowski, III et al. |
| 8,573,599 | B2 | 11/2013 | Wright |
| 8,807,453 | B2 | 8/2014 | Hsieh |
| 9,067,220 | B2 | 6/2015 | Wright |
| 9,321,067 | B2 | 4/2016 | Schaer, III et al. |
| 2001/0017323 | A1 | 8/2001 | Feller et al. |
| 2015/0034136 | A1 | 2/2015 | Bakke et al. |
| 2015/0083536 | A1 | 3/2015 | Andersen |
| 2016/0008826 | A1 | 1/2016 | Schneider |

PRIOR ART

SELF-ROTATING TUBE CLEANING NOZZLE ASSEMBLY

This application claims priority under 35 USC § 119(e) to U.S. provisional patent application 62/409,288 filed Oct. 17, 2016, which application is incorporated herein by reference.

TECHNICAL FIELD

This application relates to tube cleaning nozzle assemblies. Related methods are also disclosed.

BACKGROUND

Tube-spinners, also referred to as self-rotating tube cleaning nozzle assemblies herein, are used in the water-blast industry to clean out heat-exchanger tubes, for example tubes in a hot water or steam boiler. Tubes-spinners are generally cylindrical in shape and two to four inches long, and range in size from about ½ inch to 1 inch in diameter. The size of tube-spinners are such that they fit inside heat exchanger tubes, with clearance between the body and tube for water and debris to flush out as the tube-spinner advances into the tube. FIG. 7 shows a general depiction of the tube cleaning process wherein pressurized water is delivered to a tube-spinner P1 via a hose H1 and lance L1 and controlled by a foot valve V1, and wherein the tube-spinner P1 is inserted into each individual tube T1 of a heat exchanger HX for cleaning.

An example prior art tube-spinner P1 is shown at FIG. 8 in the drawings. The particular example shown at FIG. 8 is a "15K Tube Spinner" manufactured by Jetstream of Houston, LLP (Houston, Tex.). As shown, the tube-spinner P1 includes a main body P100, a sleeve P200 that rotates around the main body P100, and a stationary nozzle P300 that is threaded onto the main body P100. The tube-spinner main body P100 is connected to a high pressure water source via a lance such the water flows in a direction D1 into an internal passage of the main body P100. A variety of nozzles P300 can be threaded onto the main body P100 with variously oriented and sized ports to discharge the water in spray jets, for example, spray jets S1 and S2. At the same time, the high pressure water causes the sleeve P200 to spin at very high speeds and one or more of the exiting radial jets S3 created by a hole P202 in the spinner's rotating sleeve impinges on the inside surface of the tube being cleaned. The combination of speed and pressure of the jets, along with length-wise movement of the nozzle along the tube, provide a cleaning action.

During the normal course of cleaning, there is opportunity between cleaning passes, as occurs when the tube-spinner P1 is being retracted from a tube so that it can be moved to the next one, that small particles, or sometimes viscous substances, fall into the gap G1 defined between the sleeve P200 and the body P100. These contaminants produce enough friction and/or drag that the torque produced by the jets in the sleeve cannot overcome it and the sleeve does not spin. When this happens, the process has to be stopped and the tube-spinners need to be disassembled, cleaned and reassembled.

SUMMARY

A self-rotating tube cleaning nozzle assembly is disclosed that includes at least one debris exclusion feature. The nozzle assembly includes a main body defining an internal fluid passageway, a nozzle mounted to the main body, and a sleeve rotatably disposed about the main body. In one aspect, the sleeve having at least one discharge port in fluid communication with the main body internal fluid passageway for discharging a spray and rotating the sleeve about the main body. The debris exclusion feature is defined between the main body and the sleeve and includes a stepped portion on an exterior surface of the main body that faces and overlaps with a complementarily shaped stepped portion on an interior surface of the sleeve. The debris exclusion feature forms a tortuous pathway that eliminates or reduces contaminant ingress.

The self-rotating tube cleaning nozzle assembly can also include a second debris exclusion feature defined between the nozzle and the sleeve. The second debris exclusion feature can include a stepped portion on an exterior surface of the nozzle that faces and overlaps with a complementarily shaped second stepped portion on an interior surface of the sleeve.

The self-rotating tube cleaning nozzle assembly main body can also be characterized as defining an internal fluid passageway between a first landing and a second landing each having a first diameter, wherein the main body includes a third landing having a second diameter greater than the first diameter, and wherein the first, second, and third landings are parallel to a longitudinal axis of the main body. The sleeve can also be characterized as being rotatably disposed about the main body first, second, and third landings.

DETAILED DESCRIPTION

Reference will now be made in detail to exemplary aspects of the present disclosure that are illustrated in the accompanying drawings. Wherever possible, the same reference numbers will be used throughout the drawings to refer to the same or like parts.

Figure 1:
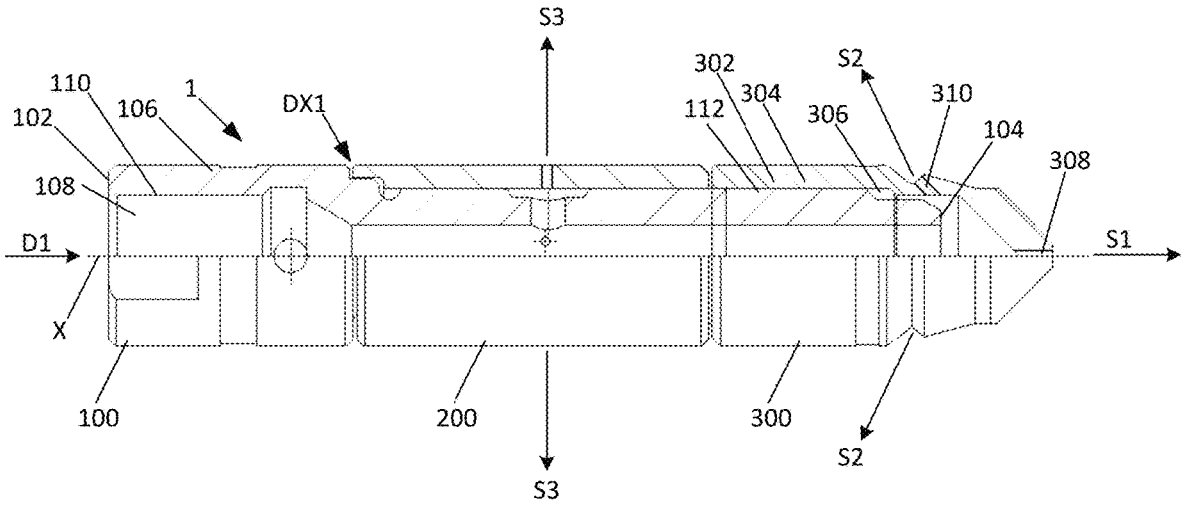
FIG. 1 is a partial cut-away side view of a self-rotating tube cleaning nozzle assembly in accordance with the present disclosure.

This disclosure relates to self-rotating tube cleaning nozzle assemblies, conventionally referred to as tube-spinners. Referring to FIG. 1, an improved nozzle assembly 1 incorporating a debris exclusion feature DX1 is presented. The debris exclusion feature DX1 is formed by features defined within the main body 100 and the sleeve 200 of the nozzle assembly. These features together create a labyrinth type passageway that eliminates, or at a minimum, greatly increases the difficulty of contaminant ingress between the main body 100 and sleeve 200. Thus, the improved nozzle assembly 1 is much less prone to binding between the sleeve 200 and main body 100, and can remain in service for longer periods of time without the need for frequent intermittent cleaning.

As presented, the nozzle assembly 1 includes a main body 100, a rotatable sleeve 200 disposed about the main body 100, and a nozzle 300 threaded onto the main body 100. The main body 100 extends between an upstream end 102 and a downstream end 104 and is formed by a tubular sidewall 106 that defines an internal passageway 108. The tubular sidewall is rotationally symmetric about a longitudinal axis X. The sidewall 106 at the upstream end 102 is provided with female threads 110 such that the main body 100 can be threaded on to a lance L1. At the downstream end 104, the sidewall 106 is provide with male threads 112 that engage with female threads 302 of the nozzle 300 such that the nozzle 300 can be securely mounted to the main body 100. Although threaded connections are shown, other types of connections may be provided.

The nozzle 300 receives water from the internal passageway 108 of the main body 100 and includes various ports in fluid communication with the passageway 108 for generating a spray for cleaning the tubes. In the example shown, the nozzle 300 is defined by a main body 302 defined by a sidewall 304 that forms a central passageway 306. The central passageway 306 is in fluid communication with the main body internal passageway 108. The nozzle 300 is provided with a central discharge port 308 for creating a forward spray jet S1 and with a plurality of circumferentially spaced ports 310 for creating radially directed spray jets S2. In the example shown, four ports 310 are provided. Many different nozzle designs and sizes can be provided for creating a desired spray pattern for a particular tube size and type.

Figure 2:
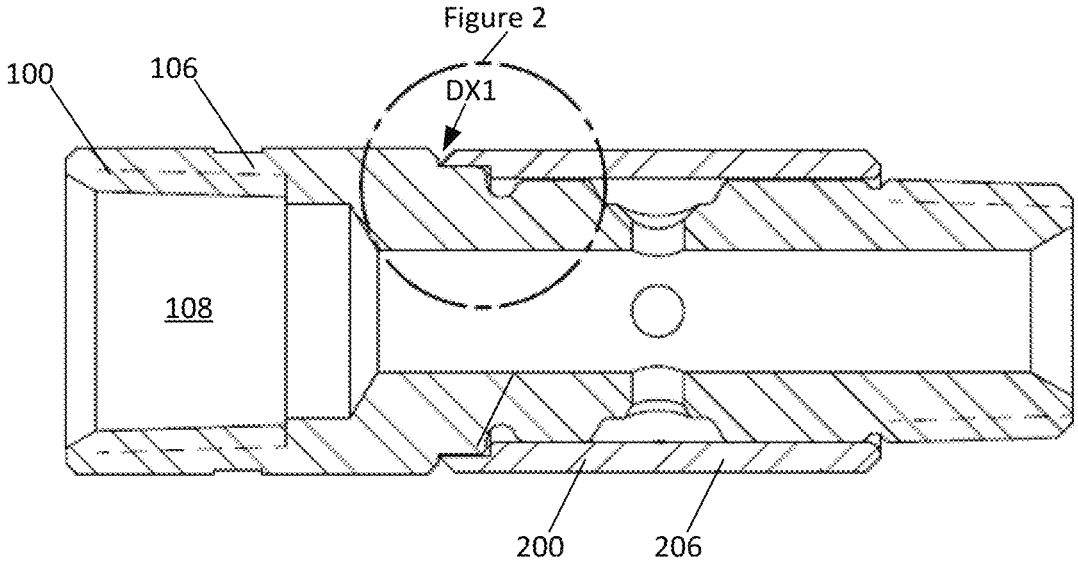
FIG. 2 is a cross-sectional side view of a main nozzle body and a sleeve of the nozzle assembly shown in FIG. 1.
Figure 3:
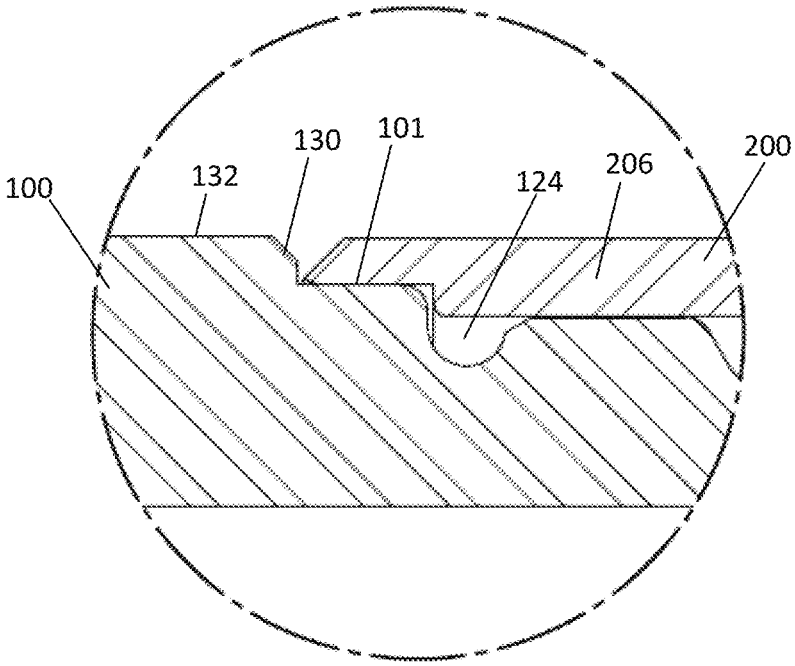
FIG. 3 is an enlarged view of a portion of the body and sleeve shown in FIG. 2.
Figure 4:
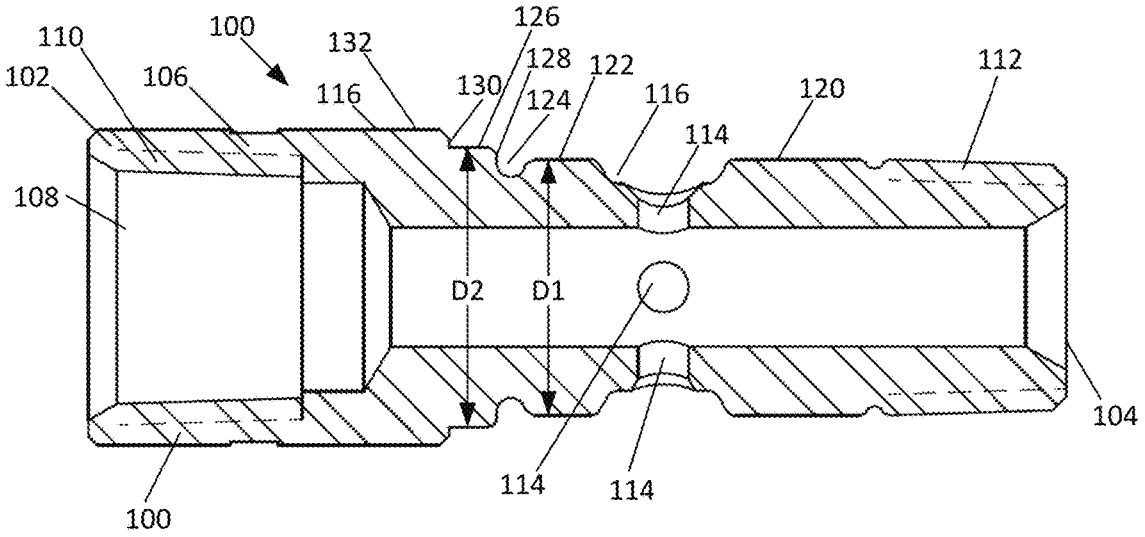
FIG. 4 is a cross-sectional side view of the main nozzle body shown in FIG. 2.
Figure 5:
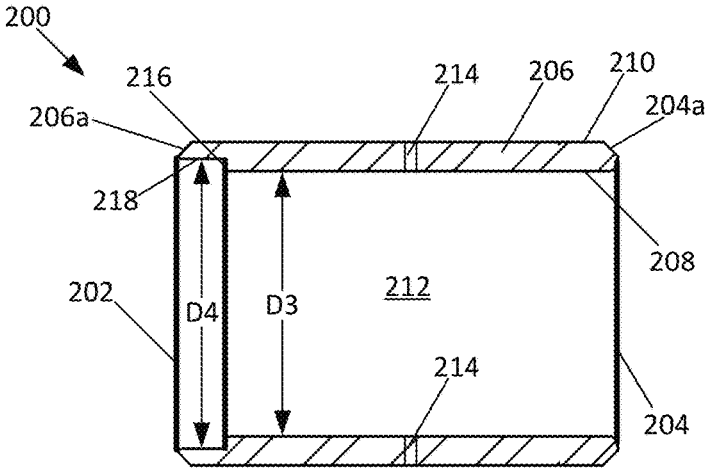
FIG. 5 is a cross-sectional side view of the sleeve shown in FIG. 2.

Referring to FIGS. 2-4, the details of the sleeve 200 and main body 100 can be seen in further detail, and in particular the features of the debris exclusion feature DX1. With regard to the main body 100, shown in isolation at FIG. 4, it can be further seen that the sidewall 106 includes a plurality of circumferentially spaced ports 114 extending between the internal passageway 108 and an exterior surface 116 of the main body 100. Each of the ports 114 extends into an pocket or opening area 118 defined between landing portions 120, 122 of the exterior surface 116. The sleeve 200, shown in isolation at FIG. 5, is disposed about the main body 100 and rests on the landing portions 120, 122 to cover the ports 114 and pocket or opening area 118. The sleeve 200 extends between an upstream end 202 and a downstream end 204 and is defined by a sidewall 206 having chamfered or angled ends 202*a*, 204*a*. The sidewall 206 extends between an interior surface 208 and an exterior surface 210 and defines a central passageway 212. At least one spray port 214 extending between the surfaces 208, 210 is provided in the sidewall 206. In the example shown, two spray ports 214 are provided. When the sleeve 200 is slid onto the main body 100, the spray ports 214 align with the pocket or opening area 118 such that pressurized fluid entering the annular ring defined by the pocket or opening area 118 and the interior surface 208 of the sleeve 200 is fed into the ports 214. The ports 214 can be oriented at an angle or provided with some other geometry that allows the pressurized fluid exiting the ports 214 to cause the sleeve 200 to rotate about the main body 100. As this action occurs, a radial spray pattern is produced that can efficiently clean the interior of a tube.

During operation, a film of water or water bearing is formed between the interior surface 208 of the sleeve and the landing portions 120, 122. This film acts as a lubricant and allows the sleeve 200 to spin freely about the main body 100. Water acting in this capacity is continually flowing from the ports 114 out towards the ends 202, 204 of the sleeve where the water then leaks out from beyond the sleeve 200. In one aspect, the landing portions 120, 122 of the main body and the inner surface 208 of the sleeve 200 are provided with a relatively polished surface to facilitate the proper formation of the water film. Due to machining limitations of the polishing process, an undercut or pocket 124 is provided at the upstream end of the landing portion 122 to ensure that the entire landing portion 122 can be polished. However, this pocket 124 creates an opportunity for debris or contaminants to undesirably collect.

Adjacent to the pocket 124, and extending from a shoulder 128 that partially defines the pocket 124, the main body 100 is provided with a landing portion 126. As shown, the landing portion 126 has a diameter D2 that is greater than a diameter D1 of the landing portions 120, 122. Accordingly, the main body 100 can be characterized as having a stepped profile with the landing portion 126 representing a step up from the landing portion 122. The main body 100 is also provided with a chamfered shoulder 130 adjacent the landing portion 126 and extending up to an outer surface 132 of the main body 100.

The sleeve 200 is provided with a complementary shape to the landing portion 128 and shoulder 128. As shown, the sleeve 200 inner surface has a stepped profile in which the inner surface 208 steps up to an inner surface 218, with a shoulder 216 extending between. The inner surface 208 has a diameter D3 while the inner surface 218 has a diameter D4 that is greater than diameter D3. The diameter D3 is slightly larger than diameter D1 while the diameter D4 is slightly greater than diameter D2.

Once the sleeve 200 is placed over the main body 100, the debris exclusion feature DX1 is formed. As most easily seen at FIG. 3, the debris exclusion feature DX1 forms a labyrinth or tortuous pathway 101 that extends from the junction of the sleeve upstream end 202 and the main body shoulder 130 to the junction of the sleeve inner surface 208 and the main body pocket 124. This labyrinth or tortuous pathway 101 greatly increases the difficulty for contaminants to ingress between the sleeve 200 and main body 100 while still allowing for pressurized water to flow between the landing portion 126 and the upstream end 202 of the sleeve 200. Thus, the debris exclusion feature DX1 prevents or eliminates contaminate build up at the pocket location 124 and at the locations between the surfaces 218 and 126 between the pocket 124 and the end 202.

Figure 6:
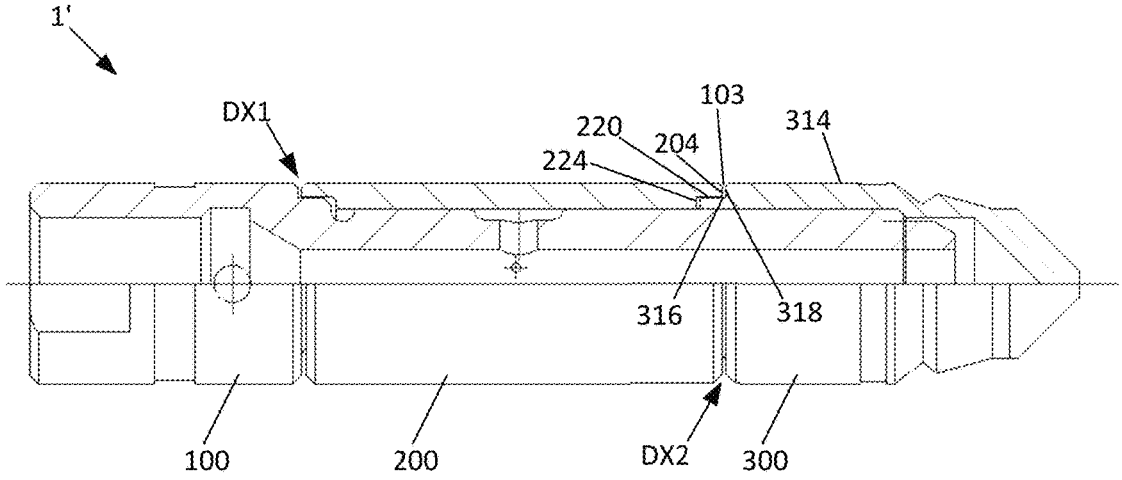
FIG. 6 is a partial cut-away side view of a modified version of the self-rotating tube cleaning nozzle assembly shown in FIG. 1.
Figure 7:
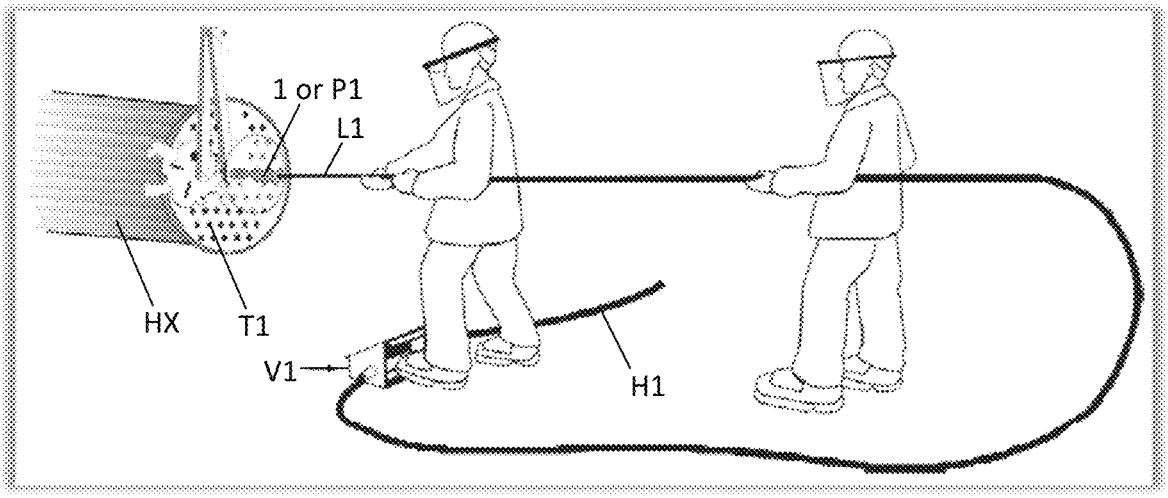
FIG. 7 is a schematic depiction of a self-rotating tube cleaning nozzle assembly being used to clean tubes.
Figure 8:
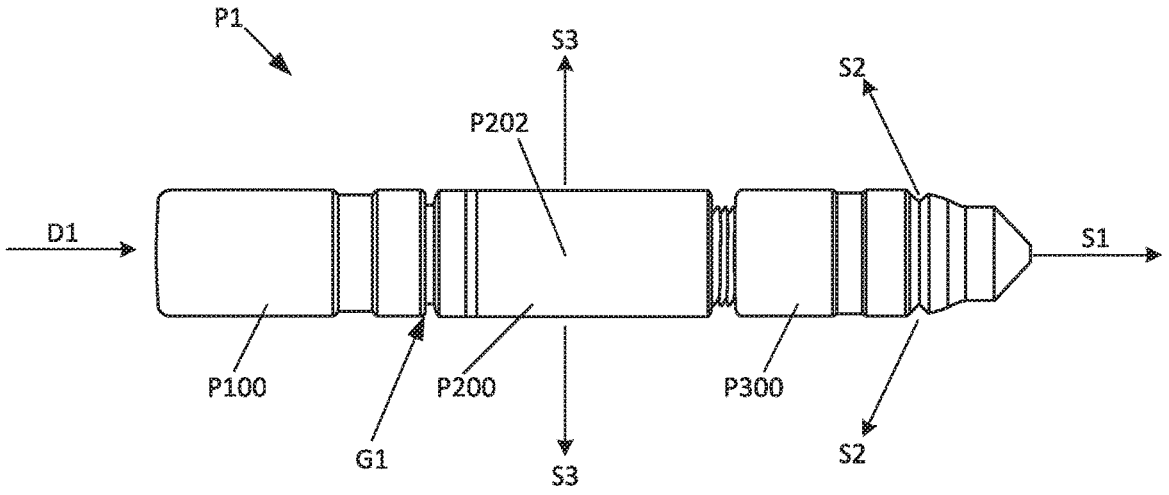
FIG. 8 is a side view of a prior art self-rotating tube cleaning nozzle assembly.

Referring to FIG. 6, a modified nozzle assembly 1' is shown. Many of the features of the assembly 1' depicted in FIG. 6 are the same as the assembly 1 depicted in FIGS. 1-5. Where similar features exist, the previous description is fully applicable for the assembly 1' of FIG. 6 and need not be repeated here. Thus, the description for the assembly 1' will be limited to differences between the assemblies 1, 1'.

The primary difference is that the assembly 1' is provided with a second debris exclusion feature DX2. The debris exclusion feature DX2 is located between the sleeve 200 and the nozzle 300 proximate the downstream end 204. As presented, the nozzle 300 is provided with a stepped outer surface in which a main outer surface 314 steps down to a smaller diameter outer surface 316. A shoulder 318 extends between the surfaces 314, 316. The sleeve 200 is provided with a complementary shape and has an inner surface 220 at a diameter D4 that is stepped away from inner surface 208 via a shoulder 224. Once the sleeve 200 is mounted onto the main body 100 and the nozzle 300 is threaded onto the main body, the sleeve inner surface 220 overlaps with the nozzle outer surface 316 such that the shoulder 318 faces the sleeve end 204 and the shoulder 224 faces the end of the nozzle 300. This arrangement forms the second debris exclusion feature DX2 and defines a labyrinth or tortuous pathway 103 between the exterior of the assembly 1 and the exterior surface of the main body 100. This construction eliminates or reduces the ingress of contaminants between the sleeve 200 and the main body 100 that could cause the sleeve 200 to bind while still allowing pressurized fluid to flow between the sleeve 200 and main body 100 towards the second end 204.

The above are example principles. Many embodiments can be made.

We claim:

1. A self-rotating tube cleaning nozzle assembly comprising:

(a) a main body defining an internal fluid passageway;

(b) a nozzle mounted to the main body;

(c) a sleeve rotatably disposed about the main body, the sleeve having at least one discharge port in fluid communication with the main body internal fluid passageway for discharging a spray and rotating the sleeve about the main body; and (d) a debris exclusion feature defined between the main body and the sleeve, the debris exclusion feature including a stepped portion on an exterior surface of the main body that faces and overlaps with a complementarily shaped stepped portion on an interior surface of the sleeve.

2. The self-rotating nozzle assembly of claim 1, wherein the main body stepped portion includes a first outer surface having a first diameter and a second outer surface having a second diameter greater than the first diameter, and wherein the sleeve interior surface overlaps with both the first and second outer surfaces.

3. The self-rotating nozzle assembly of claim 2, wherein the sleeve stepped portion includes a first inner surface having a third diameter and a second inner surface having a fourth diameter greater than the first diameter, and wherein the first inner surface overlaps with the first outer surface and the second inner surface overlaps with the second outer surface.

4. The self-rotating nozzle assembly of claim 1, further including a second debris exclusion feature defined between the nozzle and the sleeve, the second debris exclusion feature including a stepped portion on an exterior surface of the nozzle that faces and overlaps with a complementarily shaped second stepped portion on an interior surface of the sleeve.

5. The self-rotating nozzle assembly of claim 4, wherein the nozzle stepped portion includes a first outer surface having a first diameter and a second outer surface having a second diameter greater than the first diameter, and wherein the sleeve interior surface overlaps with the first outer surface.

6. The self-rotating nozzle assembly of claim 5, wherein the sleeve second stepped portion includes a first inner surface having a third diameter and a second inner surface having a fourth diameter greater than the first diameter, and wherein the second inner surface overlaps with the nozzle first outer surface.

7. The self-rotating nozzle assembly of claim 4, wherein the main body stepped portion includes a first outer surface having a first diameter and a second outer surface having a second diameter greater than the first diameter, and wherein the sleeve interior surface overlaps with both the first and second outer surfaces.

8. The self-rotating nozzle assembly of claim 7, wherein the sleeve stepped portion includes a first inner surface having a third diameter and a second inner surface having a fourth diameter greater than the first diameter, and wherein the first inner surface overlaps with the first outer surface and the second inner surface overlaps with the second outer surface.

9. The self-rotating nozzle assembly of claim 8, wherein the nozzle stepped portion includes a first outer surface having a first diameter and a second outer surface having a second diameter greater than the first diameter, and wherein the sleeve interior surface overlaps with the first outer surface.

10. The self-rotating nozzle assembly of claim 9, wherein the sleeve second stepped portion includes a first inner surface having a third diameter and a second inner surface having a fourth diameter greater than the first diameter, and wherein the second inner surface overlaps with the nozzle first outer surface.

11. The self-rotating nozzle assembly of claim 1, wherein:

(a) the main body has a first landing and a second landing each having a first diameter, and the main body has a third landing having a second diameter greater than the first diameter, wherein the first, second, and third landings are parallel to a longitudinal axis of the main body;

(b) the sleeve is rotatably disposed about the main body first, second, and third landings; and (c) the debris exclusion feature is defined between the main body third landing and the sleeve.

12. The self-rotating tube cleaning nozzle assembly of claim 11, wherein the third landing is proximate the first landing.

13. The self-rotating tube cleaning nozzle assembly of claim 12, wherein the third landing is separated from the first landing by a shoulder.

14. The self-rotating tube cleaning nozzle assembly of claim 13, wherein the third landing is further separated from the first landing by an undercut portion having a smaller outside diameter than the first diameter.

15. The self-rotating nozzle assembly of claim 11, further including a second debris exclusion feature defined between the nozzle and the sleeve, the second debris exclusion feature including a stepped portion on an exterior surface of the nozzle that faces and overlaps with a complementarily shaped second stepped portion on an interior surface of the sleeve.

16. The self-rotating nozzle assembly of claim 15, wherein the nozzle stepped portion includes a first outer surface having a first diameter and a second outer surface having a second diameter greater than the first diameter, and wherein the sleeve interior surface overlaps with the first outer surface.

17. The self-rotating nozzle assembly of claim 16, wherein the sleeve second stepped portion includes a first inner surface having a third diameter and a second inner surface having a fourth diameter greater than the first diameter, and wherein the second inner surface overlaps with the nozzle first outer surface.

* * * * *